US010041732B2

(12) United States Patent
Shortt et al.

(10) Patent No.: US 10,041,732 B2
(45) Date of Patent: Aug. 7, 2018

(54) PELLET DRYER WITH OUTLET GUIDANCE PLATE

(71) Applicant: GALA INDUSTRIES, INC., Eagle Rock, VA (US)

(72) Inventors: Louis Cody Shortt, Vinton, VA (US); Richard Borland Thrasher, Jr., Troutville, VA (US); Kerry Patrick Morris, Troutville, VA (US)

(73) Assignee: GALA INDUSTRIES, INC., Eagle Rock, VA (US)

( * ) Notice: Subject to any disclaimer, the term of this patent is extended or adjusted under 35 U.S.C. 154(b) by 0 days.

(21) Appl. No.: 15/293,927

(22) Filed: Oct. 14, 2016

(65) Prior Publication Data

US 2018/0106543 A1 Apr. 19, 2018

(51) Int. Cl.

| | |
|---|---|
| ***F26B 5/08*** | (2006.01) |
| ***F26B 25/00*** | (2006.01) |
| ***F26B 17/22*** | (2006.01) |

(52) U.S. Cl.

CPC ..... *F26B 25/001* (2013.01); *F26B 5/08* (2013.01); *F26B 17/22* (2013.01)

(58) Field of Classification Search

CPC .... F26B 5/08; F26B 5/03; F26B 17/22; F26B 25/001; B04B 15/00; B04B 11/00; B29B 9/065; B26B 5/02

USPC ..... 34/58; 175/206, 207; 425/67, 196

See application file for complete search history.

(56) References Cited

U.S. PATENT DOCUMENTS

| | | | | |
|---|---|---|---|---|
| 3,241,675 | A * | 3/1966 | Pashaian | B01D 33/073 210/247 |
| 3,458,945 | A | 8/1969 | Edwards | |
| 4,565,015 | A * | 1/1986 | Hundley, III | F26B 5/08 34/175 |
| 4,896,435 | A | 1/1990 | Spangler, Jr. | |
| 5,245,345 | A | 9/1993 | Bonta et al. | |
| 5,265,347 | A * | 11/1993 | Woodson | F26B 5/08 34/182 |
| 5,638,606 | A * | 6/1997 | Bryan | F26B 5/08 34/147 |
| 5,895,617 | A * | 4/1999 | Mizuguchi | B29B 9/06 264/141 |
| 5,956,858 | A * | 9/1999 | Veal | F26B 5/08 34/138 |
| 6,063,296 | A | 5/2000 | Ackerman et al. | |

(Continued)

FOREIGN PATENT DOCUMENTS

| | | |
|---|---|---|
| DE | 4330078 | 3/1994 |
| JP | H03-054713 | 5/1991 |

(Continued)

*Primary Examiner* — Stephen M Gravini

(74) *Attorney, Agent, or Firm* — Jacobson Holman, PLLC.

(57) ABSTRACT

A pellet dryer is provided having a housing with an inlet and a two separate outlets for discharging dried pellets and fluid, a vertical bladed rotor for centrifugally separating fluid by a screen surrounding the bladed rotor, an outlet duct connected to the outlet opening for the dried pellets, and a curved outlet guidance plate close to the top of the housing. The outlet guidance plate extends from a central position above the screen through the pellet outlet opening into the outlet duct to smooth transitional movement of the pellets between the upper end of the screen and the outlet duct.

15 Claims, 2 Drawing Sheets

(56) References Cited

U.S. PATENT DOCUMENTS

| | | | | | |
|---|---|---|---|---|---|
| 6,138,375 | A * | 10/2000 | Humphries, II | F26B 5/08 | 34/147 |
| 6,438,866 | B1 | 8/2002 | Meydell et al. | | |
| 6,467,188 | B1 * | 10/2002 | Sandford | F26B 5/08 | 34/168 |
| 6,505,416 | B2 | 1/2003 | Sandford | | |
| 7,024,794 | B1 * | 4/2006 | Mynes | F26B 17/24 | 210/374 |
| 8,061,056 | B2 * | 11/2011 | Hedberg | B01D 1/14 | 118/320 |
| 8,205,350 | B2 * | 6/2012 | Aaron | F26B 5/08 | 34/58 |
| 8,365,430 | B2 | 2/2013 | Veltel et al. | | |
| 8,671,647 | B2 * | 3/2014 | Boothe | B29B 9/06 | 53/111 R |
| 8,997,370 | B2 * | 4/2015 | Holmes | F16J 15/164 | 34/181 |
| 9,032,641 | B2 * | 5/2015 | Eloo | F26B 11/0404 | 264/143 |
| 9,194,627 | B2 * | 11/2015 | Daley | F26B 5/12 | |
| 9,354,189 | B2 * | 5/2016 | Wong | G01N 21/07 | |
| 9,630,347 | B2 * | 4/2017 | Sell | B29B 9/065 | |
| 9,649,802 | B2 * | 5/2017 | Thepsimuang | C10G 73/40 | |
| 2005/0050749 | A1 | 3/2005 | Hauch | | |

FOREIGN PATENT DOCUMENTS

| | | | | |
|---|---|---|---|---|
| KR | 101534875 | B1 * | 7/2015 | F26B 5/08 |
| WO | WO 2008113560 | A3 * | 1/2009 | F26B 5/08 |
| WO | WO 2015/024707 | | 2/2015 | |

* cited by examiner

PELLET DRYER WITH OUTLET GUIDANCE PLATE

TECHNICAL FIELD

The present disclosure generally relates to pellet dryer and more particularly relates to a pellet dryer with a pellet outlet.

BACKGROUND

Centrifugal pellet dryers of both vertical and horizontal type are well known in the state of the art and include an outer housing, a screen oriented in the housing and a bladed rotor mounted in the screen for moving a slurry of fluid and pellets within the screen, to enable a discharge of fluid through the screen. A slurry inlet is provided along with two outlets for fluid and dried pellets. Centrifugal pellet dryers of the vertical type are disclosed in U.S. Pat. Nos. 3,458,945; 4,565,015; 4,896,435; 5,245,347 commonly owned by Gala Industries, Inc. In the operation of such dryers an exhaust fan as a blower at the upper end of the housing communicates directly with the interior of the dryer with the dryer rotor shaft extending upwardly from the dryer and being connected with the bladed rotor, so that the fan of the blower and the bladed rotor are driven by the same motor. The blower produces a countercurrent flow of drying air through the pellet discharge outlet duct.

One problem of such pellet dryer is to optimize the pellet discharge through said outlet duct since a varying amount of pellets are bounced back in an transition area between the end of the screen and an outlet opening in a side surface of the inner wall close to the vertical end of the housing in respect to the main rotational speed of the motor of the bladed rotor optimized in respect to an upward accelerating of the pellets by the blades of the rotor, which dictates contemporary the amount of the countercurrent flow of drying air provided by the main blower in a countercurrent direction to the upward accelerated pellets which is difficult to balance in an optimized way for both, the optimization of upward acceleration of pellets and optimization of drying the pellets by an optimized air flow. Actually there is an amount of pellets which has to be recycled since the pellets have not reached the outlet opening close to the vertical end of the housing.

SUMMARY OF THE INVENTION

An object of the present invention is to improve the output of dried pellets of a pellet dryer of vertical type. Another object of the present invention is to avoid any stacking of pieces of pellets in a transition region between the end of the screen and an outlet opening in a side surface of the inner wall close to the vertical end of the housing followed by an agglomeration of pellets in the transition region for pellets from the screen toward a pellet outlet of the pellet dryer. A further object of the invention is to minimize the bouncing back of pellets into the drying area of the pellet dryer. Still another object is to provide a centrifugal pellet dryer in accordance with the preceding objects, so that this pellet dryer does not require any additional floor space, any additional supporting structure thereby reducing overall cost. A further object of the invention is to decrease maintenance cost and elongate maintenance intervals of the pellet dryer. Still a further object of the invention is to provide an additional guidance of counter-current air in counter direction of the main flowing direction of the pellets, in particular counter-current of air entering a pellet outlet to be passed downward in the dryer housing.

These objects are solved by the subject matter of independent claim 1 and features of dependent claims. Furthermore, other desirable features and characteristics of the present invention will be apparent from the subsequent detailed description and the appended claims, taken in conjunction with the accompanying drawings and the foregoing technical field and background.

In accordance with an exemplary embodiment a pellet dryer comprising: a housing, an inlet for feeding fluid flushed pellets and two separate outlets for discharging the dried pellets and the fluid, a vertical bladed rotor for centrifugal separation of the fluid by a screen surrounding the bladed rotor and for a vertical acceleration and separation of the pellets by the blades of the rotor, wherein the outlet for dried pellets is provided above the upper end of the screen comprising an opening toward the top of the housing at an inner cylindrical side surface of the housing distant from the screen in a radially outward direction and an outlet duct connected to the opening, wherein the outlet duct is attached to the opening by an acute angle in respect to the central axis of the rotor, wherein an outlet guidance plate of curved shape is provided close to the top of the housing inside the housing in a transition region between the end of the screen and the outlet duct wherein the outlet guidance plate extents from a central position above the screen through the outlet opening into the outlet duct.

SHORT DESCRIPTION OF THE DRAWINGS

The present disclosure will be hereafter be described in conjunction with the following drawing figures, wherein like numerals denote like elements, and wherein.

DETAILED DESCRIPTION OF THE PREFERRED EMBODIMENTS

Figure 1:
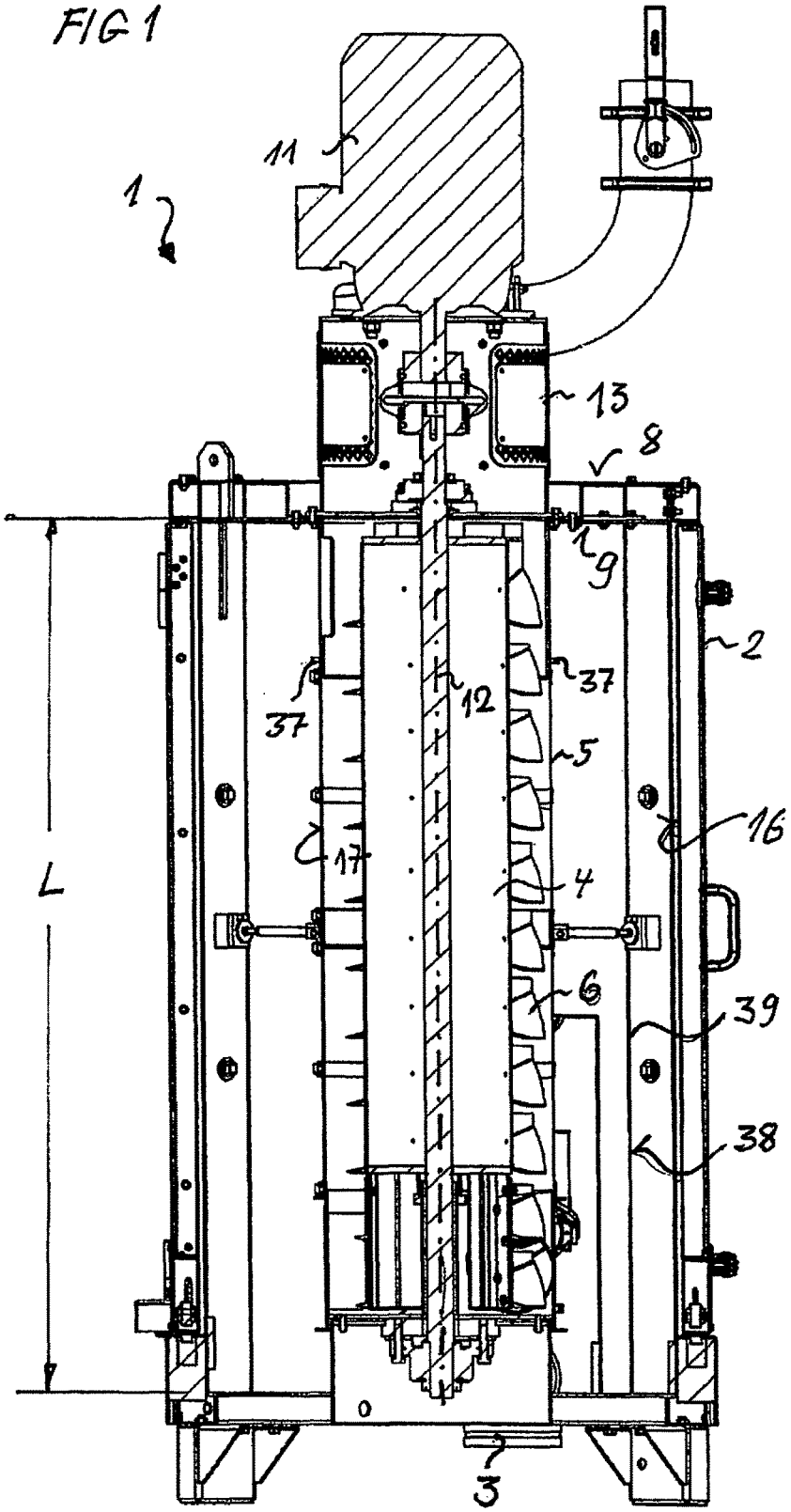
FIG. 1 is a cross sectional view of the pellet dryer according to an embodiment of the invention.
Figure 2:
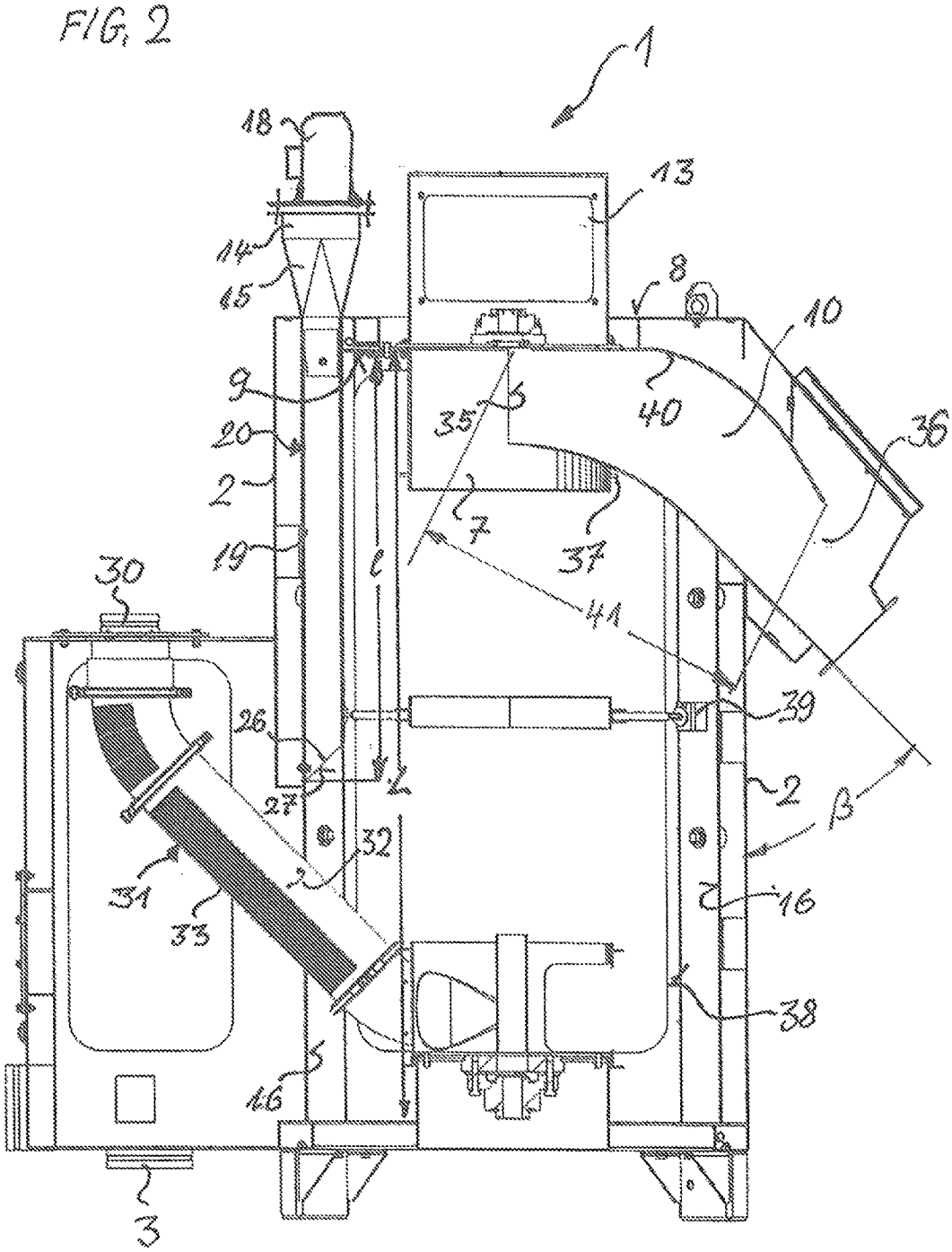
FIG. 2 is a side view of the pellet dryer according to the embodiment of the invention shown in FIG. 1.

Referring now to the drawings FIGS. 1 and 2 illustrate two different views of a centrifugal pellet dryer 1 of the vertical type according to an embodiment of the invention. The pellet dryer 1 comprises a vertical housing 2 of generally cylindrical configuration and supported in any suitable manner. A slurry of pellets and fluid enters the pellet dryer 1 through a slurry inlet 30 shown in FIG. 2 for feeding fluid flushed pellets and impinges against a fluid separator 31 in the form of an inclined and partially screened tube 32 which deflects the pellets with most of the fluid passing through the screen 33 of the tube 32 and out through a first outlet 3 of the housing 2 for the fluid.

The remaining moisture and fluid is separated from the pellets by centrifugal force applied to the remaining moisture and fluid by a vertically arranged bladed rotor 4 and a separating central screen 5 shown in FIG. 1 surrounding the bladed rotor 4 inside the housing 2. Blades 6 of the bladed rotor 4 accelerate the pellets upwards contrary to a continuously drying downwards air flow of a suction blower 18 attached to an lateral outer top 15 of the housing 2, so that the dried pellets could be accelerated to a second outlet 10 close to an inner top 9 of the housing 2 for discharging the dried pellets whilst the centrifugally separated fluid is discharged through the screen 5 toward outside the screen 5 to the first outlet 3 of the housing 2. The bladed rotor 4 is driven by one motor 11 attached centrally on the outer top 8 of the housing 2 comprising one central axis 12 for the bladed rotor 4 to provide a rotational speed.

As shown in FIG. 2 an outlet guidance plate 40 of curved shape is provided close to the inner top 9 of the housing 2 inside the housing in a transition region 41 between the end 37 of the screen 5 shown in FIG. 1 and the outlet duct 36 wherein the outlet guidance plate 40 extents from a central position above the screen 5 through the outlet opening 35 into the outlet duct 36. The guidance plate 40 is provided at the second outlet 10 of the housing 2 for dried pellets above an upper end 37 of the screen 5. Since an outlet duct 36 is attached to the opening 35 by an acute angle β in respect to the vertical central axis 12 of the rotor 4 the guidance plate 40 smoothes the transition region 41 between the end 37 of the screen 5 and the outlet duct 36 for guiding the pellets smoothly toward the outlet duct 36.

Accordingly any stacking of pieces of pellets in the transition region 41 between the end 37 of the screen 5 and an outlet opening 35 in a side surface 16 of the inner wall close to the vertical end of the housing 2 followed by an agglomeration of pellets in the transition range 41 for pellets from the screen 5 toward the pellet outlet duct 36 of the pellet dryer 1 is avoided. Further, the bouncing back of pellets into the drying area of the pellet dryer 1 is minimized. Furthermore, this pellet dryer 1 does not require any additional floor space, any additional supporting structure thereby reducing overall cost. Still further, the maintenance intervals of the pellet dryer 1 can be elongated and accordingly the maintenance cost will decrease. The outlet guiding plate furthermore influences the direction of flow of the counter current of air entering into the outlet duct 36 and moving further into the dryer housing 2.

In another embodiment of the invention the cross section of the outlet guidance plate 40 in the length direction comprises in a center part a flattened contour and toward the outlet duct 36 a gradually increasing curved profile. This gradually increasing curved profile toward the outlet duct 36 supports an avoidance on bouncing back of pellets toward the drying region of the pellet dryer 1.

In a further embodiment of the invention the cross section of the outlet guidance plate 40 in width direction comprises in a center part a flattened contour and toward the outlet opening 35 a smoothly curved profile. This smoothly curved profile toward the outlet opening 35 supports an avoidance on bouncing back of pellets toward the drying region of the pellet dryer 1.

Furthermore, the outlet guidance plate 40 is made of a metal alloy especially aluminum bronze which is resistive against corrosion. Another embodiment of the invention applies stainless steel for the outlet guidance plate 40 which is resistive against corrosion and erosion, The outlet guidance plate 40 can be equipped with a wear protection at least on the inner concave surface thereof.

Furthermore, the outlet guidance plate 40 can be fixed by quick disconnect features, allowing for easy exchange thereof.

The foregoing detailed description of embodiments of the invention has been presented for purposes of illustration and description, but it is not intended to be exhaustive or limited to the invention as disclosed. Many modifications and variations will be apparent to those of ordinary skill in the art without departing from the scope and spirit of the invention defined by the claims, which includes known equivalents and foreseeable equivalents at the time of filing the application. The embodiments were chosen and described in order to best explain the principles of the invention and then practical application, and to enable others of ordinary skill in the art to understand the invention for various embodiments with various modifications as are suited to the particular use contemplated.

LIST OF REFERENCE SIGNS

1 centrifugal pellet dryer
2 vertical housing
3 first outlet of housing for fluid
4 bladed rotor
5 central screen
6 blades of bladed rotor
7 sleeve
8 outer top of housing
9 inner top of housing
10 second outlet of housing for pellets
11 motor
12 central axis of the rotor
13 housing for rotor coupling
16 inner surface of the housing
30 slurry inlet
31 separator
32 partially screened tube
33 inclined screen of the tube
35 outlet opening
36 outlet duct of pellets
37 end of screen
40 guidance plate
41 transition region
β acute angle of outlet duct

What is claimed is:

1. A pellet dryer comprising:

a housing having an inner top, an inlet for feeding fluid flushed pellets and two separate outlets, the two separate outlets including a first outlet for discharging dried pellets and a second outlet for discharging fluid;

a vertical bladed rotor having blades for centrifugal separation of the fluid by a screen surrounding the bladed rotor and for vertical acceleration and separation of the pellets by the blades of the bladed rotor, the first outlet for dried pellets being provided above an upper end of the screen and including an outlet opening toward the inner top of the housing at an inner cylindrical side surface of the housing distant from the screen in a radially outward direction and an outlet duct connected to the outlet opening, the outlet duct being attached to the outlet opening by an acute angle (β) in respect to a central axis of the bladed rotor; and an outlet guidance plate of curved shape provided close to the inner top of the housing inside the housing in a transition region between the upper end of the screen and the outlet duct, said outlet guidance plate extending from a central position above the screen through the outlet opening into the outlet duct.

2. The pellet dryer according to claim 1 wherein au cross section of the outlet guidance plate in length direction includes in a center part a flattened contour and toward the outlet duct a gradually increasing curved profile.

3. The pellet dryer according to claim 1 wherein a cross section of the outlet guidance plate in width direction includes in a center part a flattened contour and toward the outlet opening a smoothly curved profile.

4. The pellet dryer according to claim 1 wherein the outlet guidance plate is made of a metal alloy.

5. The pellet dryer according to claim 1 wherein the outlet guidance plate is made of stainless steel.

6. The pellet dryer according to claim 1 wherein the outlet guidance plate is equipped with a wear protection at least at a lower concave surface thereof.

7. The pellet dryer according to claim 1 wherein the outlet guidance plate is fixed by a quick disconnect feature.

8. A pellet dryer comprising:

a housing having an inlet for feeding fluid flushed pellets, a first outlet for discharging dried pellets and a second outlet for discharging fluid;

a vertical bladed rotor for centrifugal separation of the fluid by a screen surrounding the bladed rotor and for vertical acceleration and separation of the pellets by blades of the bladed rotor, the first outlet for dried pellets being provided at an upper end of the screen and including an outlet opening adjacent an upper end of the housing;

an outlet duct connected to the outlet opening, the outlet duct extending at an acute angle in respect to a central axis of the bladed rotor; and an outlet guidance plate extending from the upper end of the screen through the outlet opening and into the outlet duct, said outlet guidance plate having a curved surface for smoothing transitional movement of the pellets between the upper end of the screen and the outlet duct.

9. The pellet dryer according to claim 8 wherein a cross section of the outlet guidance plate in a length direction includes a flattened contour in a center part of said outlet guidance plate and a gradually increasing curved profile toward the outlet duct.

10. The pellet dryer according to claim 8 wherein a cross section of the outlet guidance plate in a width direction includes a flattened contour in a center part of said outlet guidance plate and a smoothly curved profile toward the outlet opening.

11. The pellet dryer according to claim 8 wherein the outlet guidance plate is made of a metal alloy.

12. The pellet dryer according to claim 8 wherein the outlet guidance plate is made of stainless steel.

13. The pellet dryer according to claim 8 wherein the curved surface of the outlet guidance plate includes an inner concave surface.

14. The pellet dryer according to claim 13 wherein the outlet guidance plate is equipped with a wear protection on at least the inner concave surface thereof.

15. The pellet dryer according to claim 8 wherein the outlet guidance plate is fixed by a quick disconnect feature.

* * * * *